US007848671B2

(12) United States Patent
Mochizuki

(10) Patent No.: US 7,848,671 B2
(45) Date of Patent: Dec. 7, 2010

(54) IMAGE FORMING APPARATUS WITH MULTIPLE IMAGE FORMING PORTIONS AND IMAGE TRANSFERS

(75) Inventor: Jun Mochizuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 537 days.

(21) Appl. No.: 11/876,423

(22) Filed: Oct. 22, 2007

(65) Prior Publication Data

US 2008/0101811 A1 May 1, 2008

(30) Foreign Application Priority Data

Oct. 27, 2006 (JP) ..... 2006-292010

(51) Int. Cl.
*G03G 15/16* (2006.01)

(52) U.S. Cl. ..... 399/66; 399/302

(58) Field of Classification Search ..... 399/66, 399/223, 228, 231, 302, 308
See application file for complete search history.

(56) References Cited

U.S. PATENT DOCUMENTS

| | | | | |
|---|---|---|---|---|
| 6,163,672 | A * | 12/2000 | Parker et al. | 399/223 |
| 6,904,245 | B2 | 6/2005 | Mochizuki et al. | |
| 6,990,300 | B2 | 1/2006 | Saito et al. | |
| 7,106,984 | B2 | 9/2006 | Katsumi | |
| 7,130,550 | B2 | 10/2006 | Mochizuki | |
| 7,130,568 | B2 | 10/2006 | Mochizuki | |
| 7,136,600 | B2 * | 11/2006 | Yamanaka et al. | 399/66 |
| 7,634,207 | B2 * | 12/2009 | Miyamoto et al. | 399/66 |
| 2006/0210326 | A1 * | 9/2006 | Takehara et al. | 399/302 |

FOREIGN PATENT DOCUMENTS

| | | | |
|---|---|---|---|
| JP | 2001-226680 | A | 8/2001 |
| JP | 2003-5581 | A | 1/2003 |
| JP | 2003-295730 | A | 10/2003 |
| JP | 2004-212542 | A | 7/2004 |
| JP | 2004-333587 | A | 11/2004 |
| JP | 2005-164698 | A | 6/2005 |
| JP | 2005148198 | A * | 6/2005 |

* cited by examiner

*Primary Examiner*—Robert Beatty
(74) *Attorney, Agent, or Firm*—Fitzpatrick, Cella, Harper & Scinto

(57) ABSTRACT

An image forming apparatus according to an exemplary embodiment of the invention includes a first image forming portion, a second image forming portion, a secondary transfer device, a transfer power supply, a controller.

The first and second image forming portions include image bearing members, chargers, development devices, and transfer members.

The first charger charges the first image bearing member in the same polarity as a predetermined polarity.

The second charger for charging the second image bearing member in a polarity opposite the predetermined polarity.

The controller controls the transfer power supply such that the transfer voltage applied to the second transfer member in the second image forming portion is not changed nor turned on and off in a period during which the toner image is transferred to the intermediate transfer member in the first image forming portion.

14 Claims, 14 Drawing Sheets

PRIOR ART

IMAGE FORMING APPARATUS WITH MULTIPLE IMAGE FORMING PORTIONS AND IMAGE TRANSFERS

BACKGROUND OF THE INVENTION

1. Field of the Invention

The present invention relates to an image forming apparatus, such as a copying machine and a printer, having a plurality image forming portions in which an image is formed by an electrophotographic system.

2. Description of the Related Art

An image forming method in a color image forming apparatus in which a multiple intermediate transfer method is used will be described with reference to FIG. 10.

Four process units which are of electrophotographic-system image forming portions are provided according to yellow, magenta, cyan, and black colors.

In FIG. 10, there are shown photosensitive drums 1*a* to 1*d*, charging means 2*a* to 2*d*, exposure means 3*a* to 3*c*, development means 4*a* to 4*d*, an intermediate transfer belt 51, primary transfer members 53*a* to 53*d*, and photosensitive drum cleaners 6*a* to 6*d*. In addition, secondary transfer members 56 and 57, and an intermediate transfer belt cleaner 55 are also shown. After the photosensitive drums 1*a* to 1*d* are uniformly charged with the charging means 2*a* to 2*d*, the exposure means 3*a* to 3*d* perform exposure according to an image signal, thereby forming electrostatic latent images on the photosensitive drums 1*a* to 1*d*. Then, the development means 4*a* to 4*d* develop toner images, and transfer high-voltage power supplies 34*a* to 34*d* apply transfer biases to the transfer members 53*a* to 53*d*, which allows the toner images on the photosensitive drums 1*a* to 1*d* to be sequentially transferred to the intermediate transfer belt 51.

The images sequentially multiple-transferred onto the intermediate transfer belt 51 from the photosensitive drums 1*a* to 1*d* are transferred to a recording material P by applying a secondary transfer bias between secondary transfer members 56 and 57. The toner image on the recording material P is fixed by a fixing device 7 to obtain a full-color image.

The intermediate transfer belt having a self-attenuation property whose surface resistivity is lower than about 1013 Ω/□ (with a probe conformable to JIS-K6911, at applied voltage of 100 V for an applied time of 60 sec, at 23° C. and 50% RH) is frequently used in the image forming apparatus in which the multiple intermediate transfer method is used.

When the images are sequentially transferred from the plurality of process units using the intermediate transfer belt having the above property, because the applied voltage is not sequentially increased, it is not necessary to enlarge the transfer high-voltage power supply. Additionally, in the intermediate transfer belt having the above property, a discharge phenomenon is seldom generated in a roller portion about which the intermediate transfer belt is entrained, and the intermediate transfer belt is easy to use.

Like the image forming apparatus including a mode in which only the black toner image is formed, in the image forming apparatus in which the photosensitive drums differ from one another in an operation frequency, the photosensitive drums having different lifetimes are used according to the operation frequency of each process unit.

At this point, sometimes the photosensitive drums having the different lifetimes differ from one another in properties during the exposure.

As a result, in charging the photosensitive drums 1*a* to 1*d* with the charging means 2*a* to 2*d*, the photosensitive drum charged with the same polarity (for example, negative polarity) as charged toner and the photosensitive drum charged with an opposite-polarity (for example, positive polarity) are used while mixed.

Sometimes an image portion in which the exposure is performed by Image Area Exposure (IAE) and an image portion in which the exposure is performed by Background Area Exposure (BAE) are mixed.

A: In the image area exposure method, the photosensitive drum is charged with the negative polarity to expose and develop the image area. The transfer bias having a polarity opposite the toner and a predetermined potential difference (transfer contrast voltage) with a drum potential at the image portion is applied to transfer the toner image from the photosensitive drum to the intermediate transfer member.

B: In the background area exposure method, the photosensitive drum is charged with the positive polarity, the background area is exposed, and the non-exposed portion is developed. The transfer bias having a polarity opposite the toner and the predetermined potential difference (transfer contrast voltage) with the drum potential at the image portion is applied to transfer the toner image from the photosensitive drum to the intermediate transfer member.

FIG. 11 shows a relationship between the photosensitive drums 1*a* to 1*d* and the potential at the transfer member when the toner charged in the negative polarity is developed.

There are the process unit in which the photosensitive drum is charged with the negative polarity using the negative toner to form the image by the image area exposure method as shown in FIG. 11 and the process unit in which the photosensitive drum is charged with the positive polarity to form the image by the background area exposure method. It is found that the following problems are generated when the same image forming apparatus is provided with the two different process units to adopt the image multiple transfer method.

That is, as shown in FIG. 11, when the toner image on the photosensitive drum is transferred, the transfer bias having the predetermined potential difference (transfer contrast voltage) is applied to the transfer member. At this point, in the process unit of A: image area exposure method, the photosensitive drum surface is with the negative polarity. Therefore, the toner image with the negative polarity can be transferred by applying a relatively small positive voltage as a transfer bias Va.

On the other hand, in the process unit of B: background area exposure method, the photosensitive drum surface is with the positive polarity. Therefore, the voltage higher than the transfer bias Va is applied as a transfer bias Vb to obtain the predetermined potential difference.

The potential difference is increased between the process unit of the image area exposure method and the process unit of the background area exposure method, in the image forming apparatus in which the process unit of the image area exposure method and the process unit of the background area exposure method are next to each other. That is, the potential difference becomes extremely large between a negative surface potential of the photosensitive drum in the process unit of the image area exposure method and the positive transfer bias Vb applied to the transfer member of the background area exposure method. This causes a phenomenon called "interference" as described below. A transfer current flows to an adjacent image forming portion from a primary transfer member of an image forming portion, which creates lack of the transfer current to generate defective image. Once the transfer bias of the adjacent transfer member is turned on or off, a change in transfer current is generated to form a step in image density.

The transfer biases of the adjacent process units are set to have close values, in the image forming apparatus in which only the negatively charged process unit of the image area exposure method is used and the image forming apparatus in which only the positively charged process unit of the background area exposure method is used. Therefore, only a minor interference phenomenon is generated.

However, as described above, it is difficult to avoid an interference phenomenon in the image forming apparatus in which the negatively charged photosensitive drum and the positively charged photosensitive drum are simultaneously used. Unfortunately, once the transfer bias of the adjacent transfer member is turned on or off, the change in transfer current is generated to form the step in the image density.

SUMMARY OF THE INVENTION

An object of the invention is to reduce the image defect caused by the interference in the image forming apparatus provided with the image forming portion in which the surface of the image bearing member is charged with the same polarity as the toner and the image forming portion in which the surface of the image bearing member is charged in the polarity opposite the toner. Another object of the invention is to reduce the image defect caused by the interference in the image forming apparatus provided with the image forming portion which forms the toner image in the exposure region of the image bearing member and the image forming portion which forms the toner image of the non-exposure region of the image bearing member.

A first aspect according to the invention provides an image forming apparatus including a first image forming portion; wherein the first image forming portion includes a first image bearing member; first charging means for charging the first image bearing member in a polarity identical to a predetermined polarity to form an electrostatic latent image; first development means for developing the electrostatic latent image on the first image bearing member to form a toner image charged with the predetermined polarity; and a first transfer member which electrostatically transfers the toner image to an intermediate transfer member, a second image forming portion; wherein the second image forming portion includes a second image bearing member; second charging means for charging the second image bearing member in a polarity opposite the predetermined polarity to form an electrostatic latent image; second development means for developing the electrostatic latent image on the second image bearing member to form a toner image charged with the predetermined polarity; and a second transfer member which electrostatically transfers the toner image to the intermediate transfer member, secondary transfer means for transferring the toner image on the intermediate transfer member to a recording material; transfer voltage applying means for applying transfer voltages to the first and second transfer members when the toner image is transferred to the intermediate transfer member; and means for controlling the transfer voltage applying means such that the transfer voltage applied to the second transfer member in the second image forming portion is not changed nor turned on and off in a period during which the toner image is transferred to the intermediate transfer member in the first image forming portion.

DESCRIPTION OF THE EMBODIMENTS

An image forming apparatus according to a preferred embodiment of the invention will be described below with reference to the drawings.

First Embodiment

Figure 1:
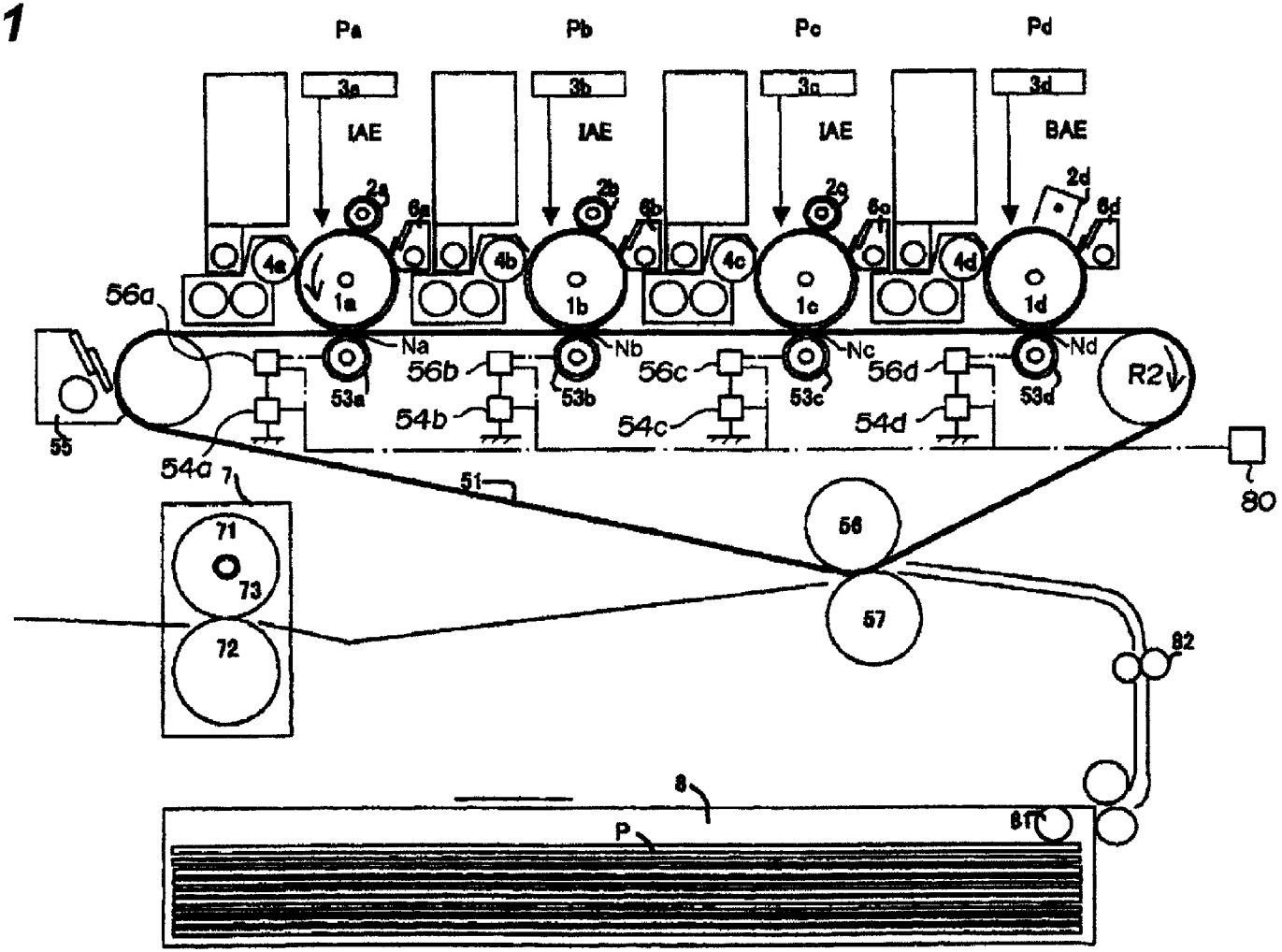
FIG. 1 shows a schematic configuration of an image forming apparatus according to a first embodiment of the invention.

FIG. 1 shows a schematic configuration of an image forming apparatus according to a first embodiment of the invention. The image forming apparatus of the first embodiment includes four image forming portions. The image forming apparatus is a full-color electrophotographic image forming apparatus, in which toner images formed in the image forming portions are primary-transferred to an intermediate transfer member and the primary-transferred image is secondary-transferred to a recording medium to obtain a color image.

[Overall Configuration of Image Forming Apparatus]

An overall configuration of the image forming apparatus will be described. As shown in FIG. 1, process units Pa, Pb, Pc, and Pd which are of the four image forming portions are horizontally arranged to form the images of yellow Y, magenta M, cyan C, and black K colors. Photosensitive drums 1*a*, 1*b*, 1*c*, and 1*d* are arranged in the process units Pa, Pb, Pc, and Pd while being able to be rotated in an arrow direction.

In the image forming apparatus of the first embodiment, the photosensitive drums 1*a*, 1*b*, and 1*c* which form the yellow, magenta, cyan toner images adopt the image area exposure method in which the photosensitive drum is charged in the negative polarity with charging means to develop the exposure portion. On the other hand, the photosensitive drum 1*d* which forms the black toner image adopts the background area exposure method in which the photosensitive drum is charged in the positive polarity with the charging means to develop the non-exposure portion.

A configuration of a process unit will be described below with reference to FIGS. 2 and 3. The process units Pa, Pb, and Pc have the same configuration, so that the letters a, b, c, and d are neglected except in required situations.

Figure 2:
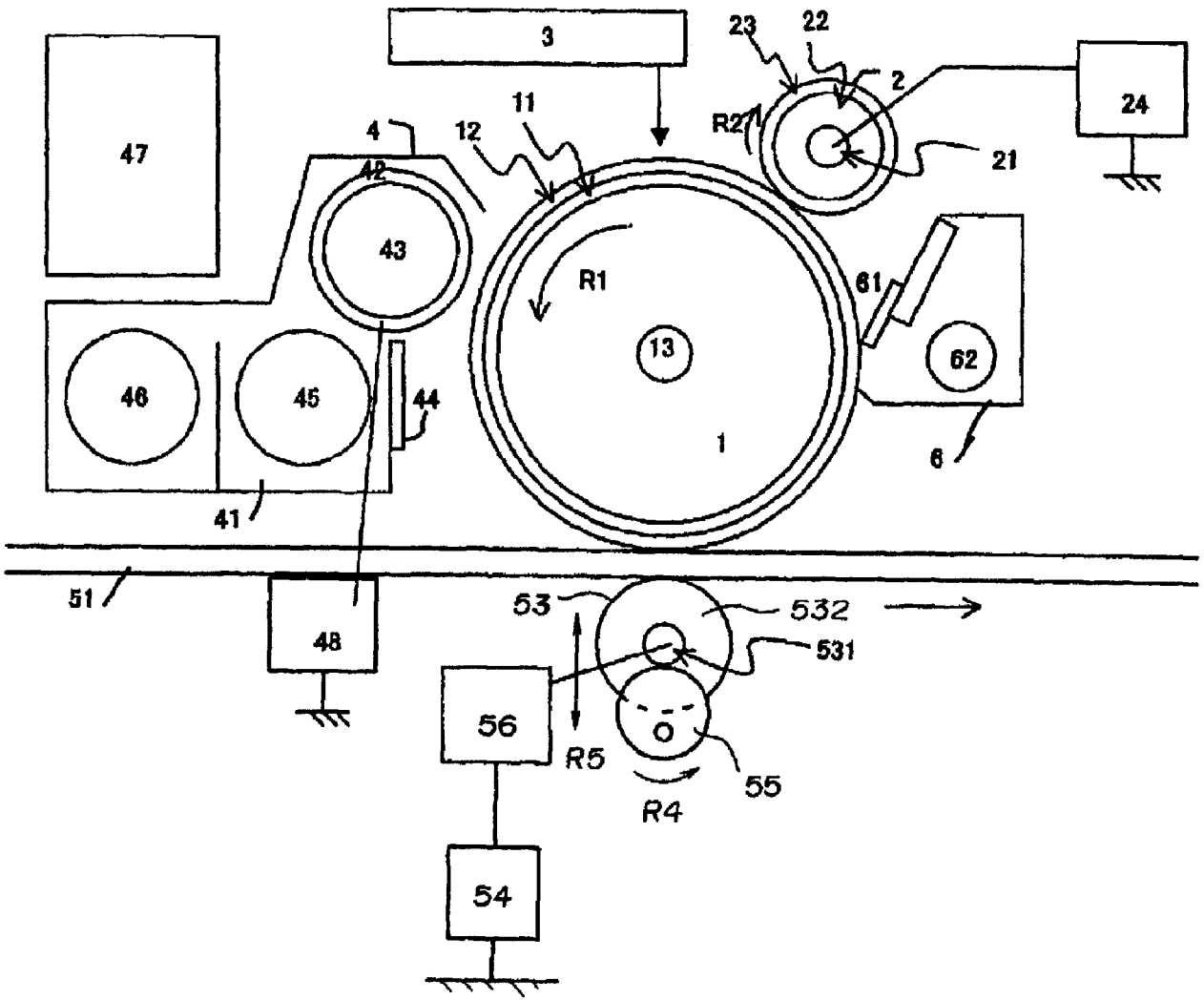
FIG. 2 shows a schematic configuration of a process unit in the image forming apparatus of the first embodiment of the invention.

FIG. 2 shows a schematic configuration of the yellow, magenta, and cyan process units Pa, Pb, and Pc constituting a first image forming portion. FIG. 3 shows a schematic configuration of the black process unit Pd constituting a second image forming portion.

As shown in FIG. 2, each of the yellow, magenta, and cyan process units Pa, Pb, and Pc which are of the first image forming portion includes photosensitive drum 1 as the image bearing member, the photosensitive drum 1 is supported by an apparatus main body (not shown) while being able to be rotated. The photosensitive drum 1 is formed by a cylindrical OPC photosensitive member mainly including a conductive base 11 made of aluminum or the like and a photoconductive layer 12 formed on an outer circumference of the conductive base 11. The photosensitive drum 1 has a support shaft 13 in the center thereof, and the photosensitive drum 1 is rotated about the support shaft 13 in a direction of an arrow R1 by driving means (not shown).

A charging roller 2 which is of charging means is disposed on the photosensitive drum 1. The charging roller 2 is in contact with the surface of the photosensitive drum 1 to uniformly charge the surface in a predetermined polarity (negative polarity in the first embodiment) at a potential. The charging roller 2 is formed in a roller shape as a whole.

The charging roller 2 includes a conductive core metal 21 disposed in the center, a low-resistance conductive layer 22 formed on the outer circumference of the core metal 21, and an intermediate-resistance conductive layer 23 formed on the outer circumference of the low-resistance conductive layer 22. End portions of the core metal 21 are journaled in bearing members (not shown), and the core metal 21 is disposed in parallel with the photosensitive drum 1. The bearing members located in the end portions of the core metal 21 are biased toward the photosensitive drum 1 by pressing means (not shown), which presses the charging roller 2 against the surface of the photosensitive drum 1 with a predetermined pressing force. The charging roller 2 is driven in a direction of an arrow R2 in association with the rotation of the photosensitive drum 1 in the direction of the arrow R1. A power supply 24 applies the bias voltage to the charging roller 2 to uniformly contact-charge the surface of the photosensitive drum 1.

Exposure means 3 is provided on a downstream side of the charging roller 2 with respect to the rotating direction of the photosensitive drum 1. The exposure means 3 scans and exposes the photosensitive drum 1 while tuning on and off a laser beam based on image information, and the exposure means 3 forms the electrostatic latent image according to the image information.

Development means 4 disposed on the downstream side of the exposure means 3 has a development vessel 41 in which a two-component developer is stored. In the development vessel 41, a development sleeve 42 is rotatably positioned in an opening facing the photosensitive drum 1. A magnet roller 43 bearing the developer on the development sleeve 42 is rigidly disposed in the development sleeve 42 while not rotated with respect to the rotation of the development sleeve 42. A regulating blade 44 is disposed in a lower portion of the development sleeve 42 of the development vessel 41. The regulating blade 44 forms a thin developer layer by regulating the developer borne on the development sleeve 42.

A development chamber 45 and an agitating chamber 46 are provided in the development vessel 41 while partitioned from each other, and a replenishing chamber 47 in which replenishing toner is stored is provided above the development chamber 45 and agitating chamber 46. When the developer formed in the thin developer layer is conveyed to a development region facing the photosensitive drum 1, a string of developers rises by a magnetic force of a development main electrode located in the development region of the magnet roller 43, which allows the magnetic brush of the developer to be formed. While the magnetic brush scrubs the surface of the photosensitive drum 1, the power supply 48 applies the development bias voltage to the development sleeve 42. Therefore, the toner adhering to the carrier constituting the string of developers in the magnetic brush adheres to the exposure portion of the electrostatic latent image to form the toner image on the photosensitive drum 1.

Thus, in the first image forming portion, the charging means 2 charges the surface of the photosensitive drum 1 in the same negative polarity as the toner, the exposure is performed to the image region on the photosensitive drum 1 to develop the toner image in the exposure region.

A transfer roller 53 which is of a transfer charging member is provided below the photosensitive drum 1 on the downstream side of the development means 4. The transfer roller 53 includes a core metal 531 and a cylindrical conductive layer 532. A power supply 54 which is of transfer voltage applying means applies a bias to the core metal 531, and the conductive layer 532 is formed on the outer circumferential surface of the core metal 531. End portions of the transfer roller 53 are biased toward the photosensitive drum 1 by pressing members (not shown) such as a spring, which allows the conductive layer 532 of the transfer roller 53 to be brought into press contact with the surface of the photosensitive drum 1 with a predetermined pressing force while the intermediate transfer belt 51 is interposed therebetween. Therefore, a transfer nip portion is formed between the photosensitive drum 1 and the transfer roller 53.

The transfer roller 53 can be moved in a direction of an arrow R5 to be brought into contact with and separated from the surface of the photosensitive drum 1 by rotation (R4 direction) of a cam 55. An intermediate transfer belt 51 is nipped in the transfer nip portion, and the power supply 54 applies the bias voltage having the polarity opposite the polarity of the toner to the transfer nip portion, whereby the toner image on the photosensitive drum 1 is transferred to the surface of the intermediate transfer belt 51 which is of a member to be transferred. A detector (detection means) 56 is provided between the power supply 54 and the transfer roller 53 to detect the voltage applied to the transfer roller and the current passed through the transfer roller 53.

After the toner image is transferred, in the photosensitive drum 1, deposits such as a residual toner are removed by a cleaner 6. The cleaner 6 includes a cleaner blade 61 and a conveyance screw 62. The cleaner blade 62 is caused to abut on the photosensitive drum 1 at a predetermined angle with a predetermined pressure by pressurizing means (not shown), and the cleaner blade 62 recovers the toner and the like remaining on the surface of the photosensitive drum 1. The recovered residual toner and the like are conveyed and discharged by the conveyance screw 62.

Figure 3:
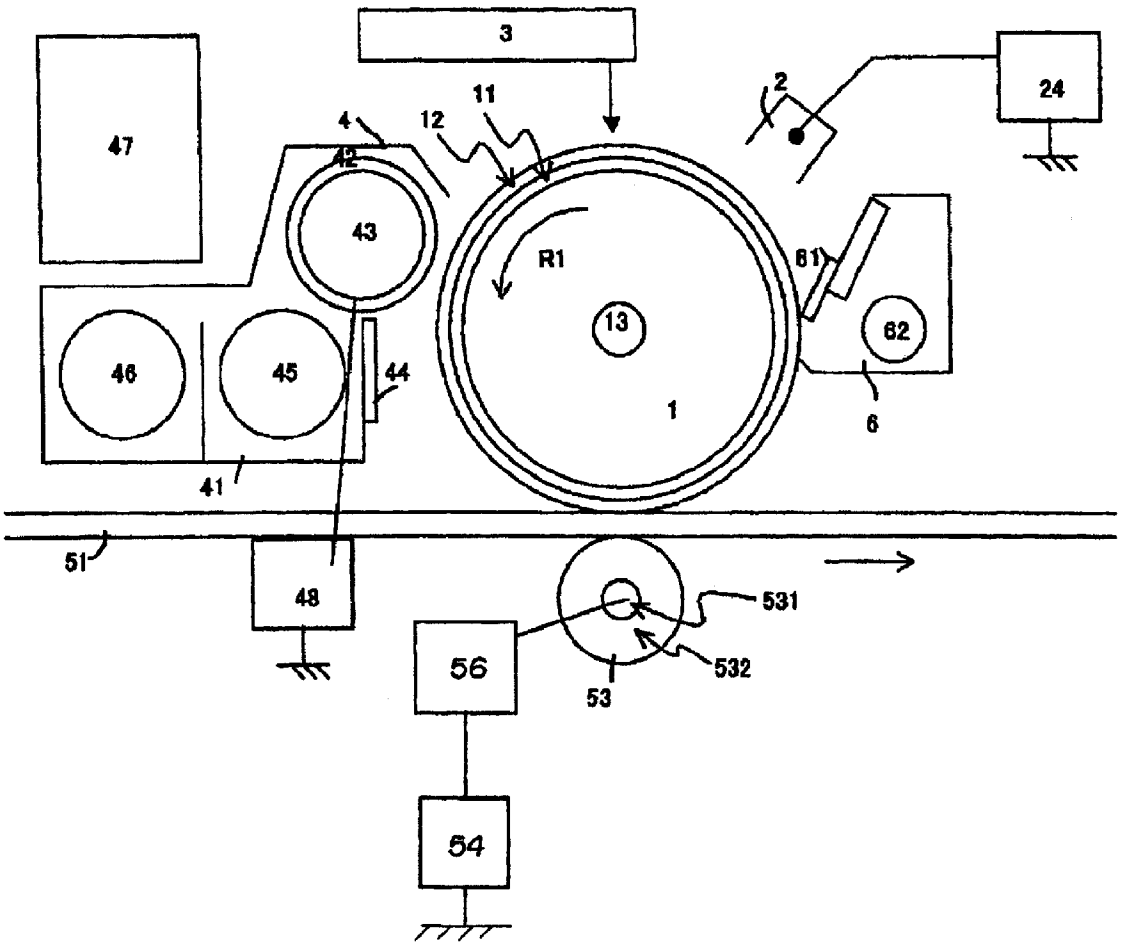
FIG. 3 shows a schematic configuration of a process unit in the image forming apparatus of the first embodiment of the invention.

The black process unit Pd which is of the second image forming portion is formed as shown in FIG. 3. The process unit Pd is an image forming portion in which an amorphous silicon photosensitive drum is used. The process unit Pd has the same configuration as the process units Pa, Pb, and Pc which are of the first image forming portion shown in FIG. 2, so that the detailed description is neglected.

Because the photosensitive drum 1 of the process unit Pd is made of the amorphous silicon, the photosensitive drum 1 of the process unit Pd has extremely high surface hardness (Vickers hardness is more than 1000), and the photosensitive drum 1 of the process unit Pd is excellence in resistance to deterioration, resistance of abrasion, a flaw-resistant property, and shock resistance compared with other photosensitive members. In the charging means 2 of the process unit Pd, corona charging means is used to uniformly charge the amorphous silicon photosensitive drum.

Although the process unit Pd forms the image like the first image forming portion, the black process unit Pd differs from the first image forming portion in that the charging means 2 charges the surface of the photosensitive drum 1 in the positive polarity opposite the toner, the exposure is performed to the background area of the photosensitive drum, and the toner image is developed in the non-exposure region.

In FIG. 1, the intermediate transfer unit is disposed below each photosensitive drum. The intermediate transfer unit includes the intermediate transfer belt 51 rotated in the direction of the arrow R2, the transfer roller 53 which is of the charging transfer member, secondary transfer rollers 56 and 57 and an intermediate transfer belt cleaner 55.

In the printer having the above configuration, the transfer bias having the polarity opposite the toner is applied to the toner images formed on the photosensitive drums 1 from the transfer rollers 53 which face the photosensitive drums 1 while the intermediate transfer belt 51 is interposed therebetween, and the toner images are sequentially transferred onto the intermediate transfer belt 51. Then, the toner images are conveyed to the secondary transfer portion according to the rotation of the intermediate transfer belt 51.

On the other hand, a recording material P stored in a sheet cassette 8 is fed to a conveyance roller 82 through a pickup roller 81 and the recording material P is further conveyed leftward. In the secondary transfer portion, the toner images are transferred onto the recording material P by a secondary transfer bias applied to the secondary rollers (secondary transfer means) 56 and 57. The residual toners and the like on the intermediate transfer belt 51 are removed and recovered by the intermediate transfer belt cleaner 55.

The fixing device 7 includes a fixing roller 71 which is rotatably provided and a pressure roller 72 which is rotated while brought into pressure contact with the fixing roller 71. A heater 73 such as a halogen lamp is provided in the fixing roller 71, and a temperature in the surface of the fixing roller 71 is adjusted by controlling the voltage applied to the heater 73. When the recording material P is conveyed, the recording material P is pressurized and heated at a substantially constant pressure and temperature from both sides in passing through the nip between fixing roller 71 and the pressure roller 72 which are rotated at constant speed. Therefore, the unfixed toner images in the surface of the recording material is melted and fixed to form the full color image on the recording material P.

The intermediate transfer belt 51 is made of a dielectric resin such as PC, PET, and PVDF. A PI resin having the surface resistivity of $10^{11.5}\Omega/\square$ (with a probe conformable to JIS-K6911, at applied voltage of 100 V for applied time of 60 sec, at 23° C. and 50% RH) and a thickness t of 100 μm is used in the first embodiment. However, other materials and other thickness may be used.

The inventor's study shows that the interference phenomenon is frequently generated in the intermediate transfer belt having the surface resistivity not more than $10^{14}\Omega/\square$. Particularly, the interference phenomenon is significantly generated in the intermediate transfer belt having the surface resistivity not more than $10^{13}\Omega/\square$. Therefore, the intermediate transfer belt having the surface resistivity not more than $10^{14}\Omega/\square$ or $10^{13}\Omega/\square$ is used as the intermediate transfer belt 51 of the first embodiment. Preferably the surface resistivity of the intermediate transfer belt 51 is not lower than $10^{9}\Omega/\square$ in order to prevent splash during transfer.

The transfer roller 53 includes the core metal having a diameter ϕ of 8 mm and a conductive urethane sponge layer having a thickness of 4 mm. The transfer roller 53 has resistance of about 10Ω (at 23° C. and 50% RH) which is determined from a relationship of the current measured by applying the voltage of 500 V to the core metal, when the transfer roller 53 is rotated at a circumferential speed of 50 mm/sec under the condition that a load of 500 g weight is applied.

The image forming apparatus of the first embodiment also includes a single color mode in which only the black toner image is formed in addition to the full color mode in which the yellow, magenta, cyan, and black toner images are formed. In the single color mode, the transfer rollers 53 of the yellow, magenta, and cyan process units Pa, Pb, and Pc are separated from the photosensitive drums 1 respectively. At the same time, the intermediate transfer belt 51 is also separated from the photosensitive drums 1. The photosensitive drums 1 are stopped in the process units Pa, Pb, and Pc, and the image is formed only in the black process unit Pd.

[Image Forming Process]

Then, an image forming process in each process unit will be described in detail from the viewpoints of the charging and exposure of the photosensitive drum and the transfer bias.

Figure 4:
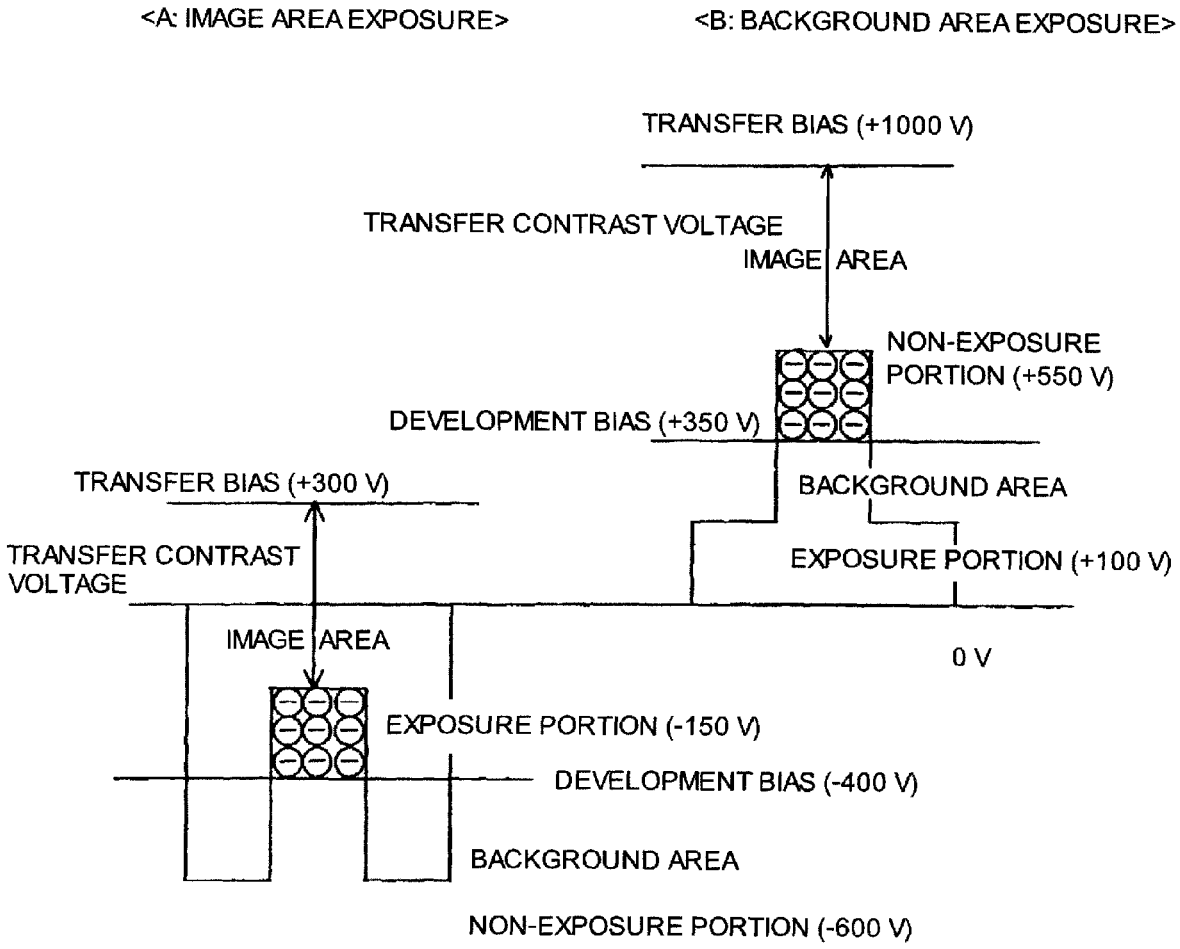
FIG. 4 shows a relationship between a photosensitive drum potential and a transfer voltage of the first embodiment of the invention.

FIG. 4 shows a relationship between the surface potential of the photosensitive drum potential and the transfer bias in the image forming apparatus of the first embodiment. The process units Pa, Pb, and Pc which are of the first image forming portion will be described. The negatively charged image area exposure method is adopted in the process units Pa, Pb, and Pc, and the surface of the photosensitive drum 1 is charged at −600 V by the charging means 2. The potential of −600 V is the potential at the so-called background area (Oh). The charge on the photosensitive drum surface is exposed and released by the exposure means 3, and the charge becomes the potential at the image area (FFh). The image area (FFh) is charged at −150 V in the first embodiment.

The development bias (−400 V DC component) is applied by the development means 4, and the negatively charged toner is developed by development contrast with the photosensitive drum potential of the exposure portion. The transfer bias of +300 V is applied to the transfer roller 53 to transfer the toner image.

On the other hand, the negatively charged background area exposure method is adopted in the process unit Pd which is of the second image forming portion, and the surface of the photosensitive drum 1 is charged at +550 V by the charging means 2. The potential of +550 V is the potential at the image area (FFh). The charge on the photosensitive drum surface is exposed and released by the exposure means 3, and the charge becomes the potential at the background area (00h). The image area (FFh) is charged at +100 V in the first embodiment. The development bias (+350 V DC component) is applied by the development means 4, and the negatively charged toner is developed by the development contrast with the photosensitive drum potential of the non-exposure portion.

At this point, the interference of the transfer current is generated between the process unit Pc which is of the first image forming portion for forming the cyan image and the adjacent process unit Pd which is of the second image forming portion for forming the black image. That is, there is a large difference between the transfer bias of +1000 V applied to the transfer roller 53*d* of the process unit Pd and the potential (−150 V at the image area and −600 V at background area) of the photosensitive drum 1*c* of the adjacent process unit Pc. Therefore, the transfer current flows from the transfer roller 53*d* into the photosensitive drum 1*c* through the intermediate transfer belt 51. For example, in the conventional technique, about 15% of the transfer current flowing from the transfer roller 53*d* flows onto the side of the photosensitive drum 1*c* of the process unit Pc.

[Interference Avoidance Control]

In the first embodiment, in order to avoid the influence of the interference caused by turning on and off the voltage applied to the transfer roller 53*d*, the controller 80 adjusts an output of the power supply 54 to perform interference avoidance control.

Figure 5A:
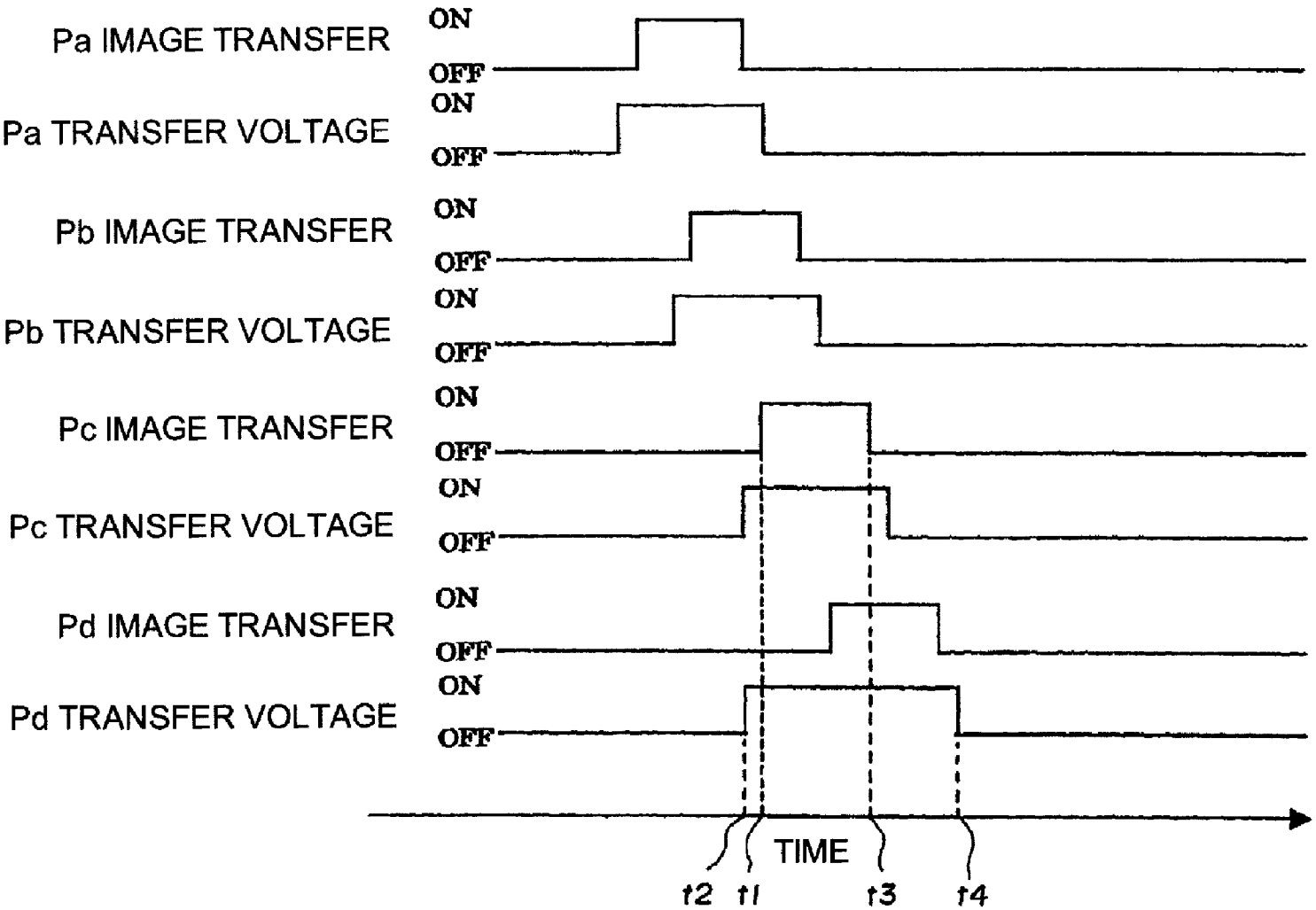
FIG. 5A shows an image and transfer voltage applying timing of the first embodiment of the invention.

FIG. 5A is a timing chart showing the transfer in each unit. A horizontal axis indicates time. FIG. 5A shows the transfer voltage applying timing when the image on the photosensitive drum passes through the transfer portion. In each process unit, the transfer bias is turned on before the image passes through the transfer portion, and the transfer bias is turned off after the image passes through the transfer portion. The yellow Y, magenta M, cyan C, and black K color images are sequentially transferred, and the adjacent process units overlap each other in a period during which the image is transferred. In the first embodiment, at the timing of starting the black image transfer in the process unit Pd, the cyan image transfer operation is continued in the process unit Pc next to the process unit Pd.

Therefore, the timing of applying the transfer bias in the black image process unit Pd is devised. In order to avoid the generation of the image density step caused by the interference with the cyan image process unit Pc, the transfer bias application is started to the transfer roller 53*d* of the black image process unit Pd at timing t2 before timing t1 of starting the cyan image transfer. The transfer bias application is stopped to the transfer roller 53*d* of the black image process unit Pd at timing t4 after timing t3 of ending the cyan image transfer.

Figure 5B:
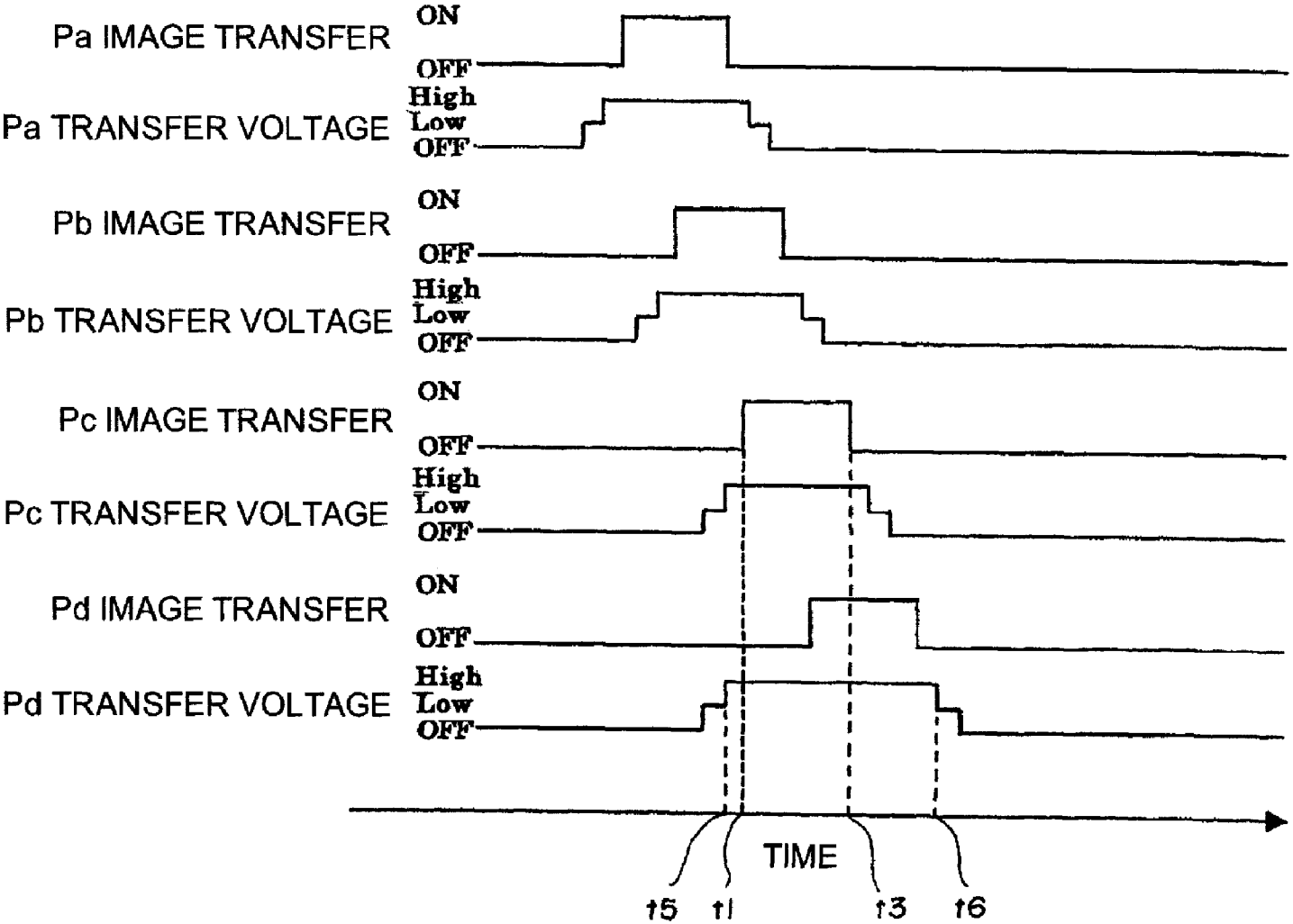
FIG. 5B shows an image and transfer voltage applying timing of the first embodiment of the invention.

As shown in FIG. 5B, the transfer bias applied to the transfer roller 53*d* of the black image process unit Pd is changed at the time except for the time from the timing t1 of starting the cyan image transfer to the timing t3 of ending the cyan image transfer. In FIG. 5B, the transfer bias is changed from +500 V (Low) to +1000 V (High) at timing t5, and the transfer bias is changed from +1000 V to +500 V at timing t6.

The voltage applied to the black transfer charging means is changed or turned on and off when the toner image is not transferred to the intermediate transfer belt in the cyan image process unit Pc.

In other words, the surface of the photosensitive drum is charged in the polarity opposite the toner to maintain the charging output of the transfer roller 53*d* at a constant level in the process unit Pd which forms the latent image, while the toner image on the photosensitive drum 1*c* in the process unit Pc in which the surface of the photosensitive drum is charged in the same polarity as the toner to form the latent image is transferred to the intermediate transfer belt 51 by receiving the bias voltage from the transfer roller 53*c*.

The charging output of the transfer roller 53*d* is maintained at a constant level in the background area exposure type process unit Pd which forms the latent image, while the toner image on the photosensitive drum 1*c* in the image area exposure type process unit Pc is transferred to the intermediate transfer belt 51 by receiving the bias voltage from the transfer roller 53*c*.

On the other hand, the extremely small interference current is generated because of the small potential difference between the transfer bias (+300 V) applied to the transfer roller 53*c* of the cyan image process unit Pc and the surface potential (+550 V) at the photosensitive drum 1*d* of the black image process unit Pd. Therefore, in the black image process unit Pd, the image density step is not generated at the timing of turning off the bias voltage of the transfer roller 53*c*.

Thus, the generation of the image density step caused by the interference with the adjacent cyan image process unit Pc at the timing of applying the transfer bias in the black image process unit Pd can be avoided.

In the first embodiment, constant-voltage control is adopted in the transfer bias applied to the transfer rollers 53*a* to 53*d*. When constant-current control is adopted, the interference current is changed by the change in surface potential of the adjacent photosensitive drum, and the amount of current flowing into the photosensitive drum 1*c* fluctuates to perform possibly the unstable transfer.

In the first embodiment, the negatively charged photosensitive drum is used in the process units Pa, Pb, and Pc, and the positively charged photosensitive drum is used in the process unit Pd. However, the order of the photosensitive drum is not limited to the first embodiment, but the arrangement of the photosensitive drum having the different charged polarity may be located on the upstream or in the middle. The polarity of the toner or photosensitive drum is not limited to the first embodiment.

In the first embodiment, the intermediate-resistance intermediate transfer belt is used in the image forming apparatus. However, even in the image forming apparatus in which the direct multiple transfer method is adopted, the above-described control is effectively performed in the case in which the belt member is used in the region where the current interference is generated or the case in which the current interference is generated by low-resistance paper.

Second Embodiment

A second embodiment of the invention is based on a transfer bias control method in the case where a lower-resistance intermediate transfer belt is used. A configuration and an operation of an image forming apparatus of the second embodiment are similar to those of the first embodiment, so that only the configuration and control different from the first embodiment will be described in detail.

In the second embodiment, a PI resin having the surface resistivity of 1011 Ω/□ (with a probe conformable to JIS-K6911, at applied voltage of 100 V for applied time of 60 sec, at 23° C. and 50% RH) and the thickness t of 100 μm is used as the intermediate transfer belt 51. The intermediate transfer belt 51 is formed by an ion-conductive belt member, and the intermediate transfer belt 51 has the advantages such as low cost and low unevenness of resistance. At the same time, a resistance fluctuates largely depending on environmental temperature and humidity, and the resistance is decreased at high temperature and high humidity. The intermediate transfer belt 51 has the surface resistivity of 1010 Ω/□ (at 30° C. and 80% RH).

In the use of the intermediate transfer belt having the above resistance, the transfer current generates the interference with not only the adjacent process unit but also the process unit on the upstream side of the adjacent process unit.

Figure 6A:
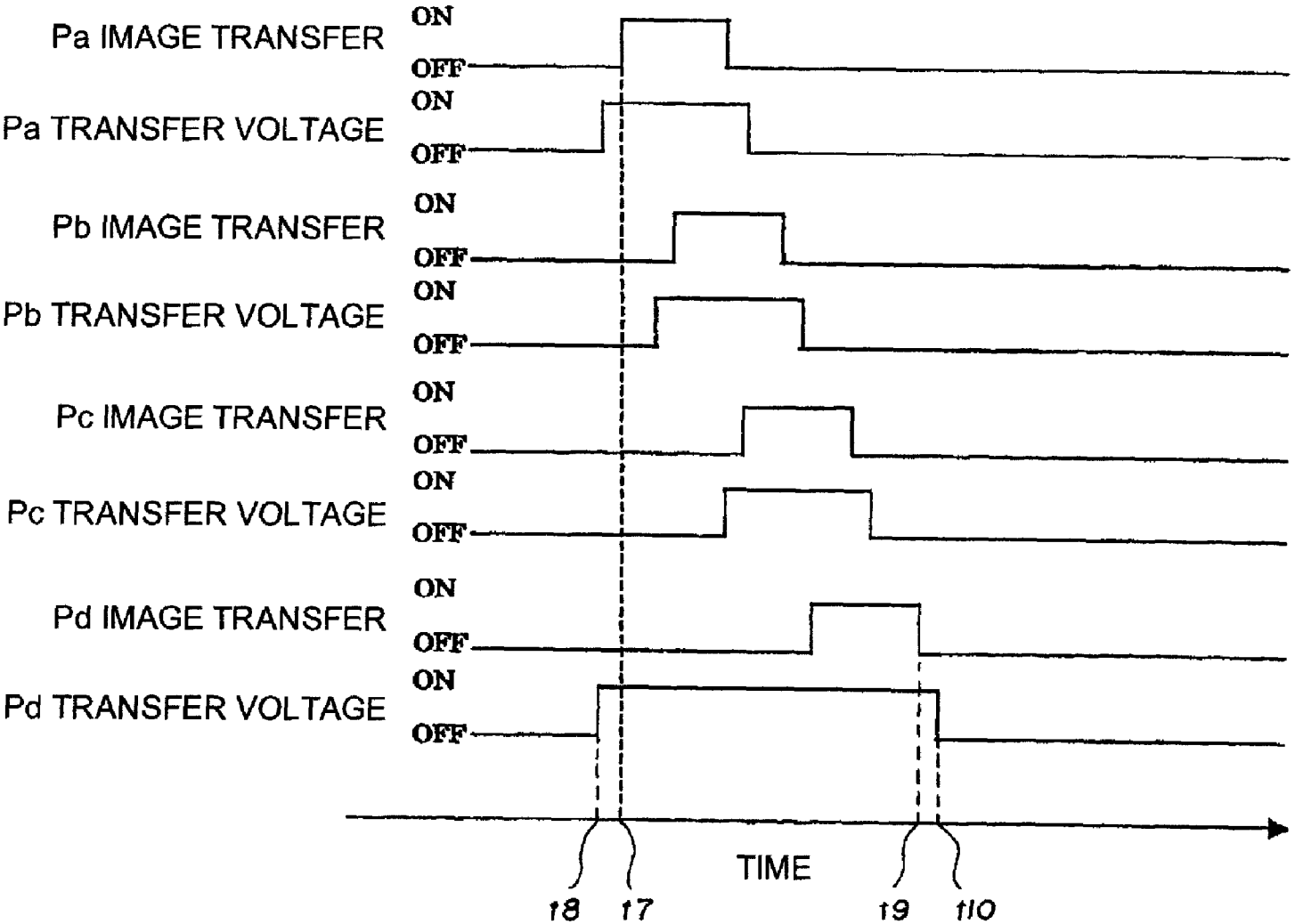
FIG. 6A shows an image and transfer voltage applying timing according to a second embodiment of the invention.

Therefore, in the second embodiment, a method shown in FIG. 6A is adopted as the transfer bias applying control. The transfer bias is applied to the transfer roller 53*d* of the process unit Pd in which the photosensitive drum is charged in the different polarity at timing t8 before timing t7 at which the process unit Pa located on the uppermost side in the belt moving direction starts the toner image transfer.

The transfer bias applied to the transfer roller 53*d* of the process unit Pd is stopped (t10) after the toner image is transferred in the process unit Pc located on the lowermost side in the belt moving direction in the process units Pa, Pb, and Pc (t9).

Figure 6B:
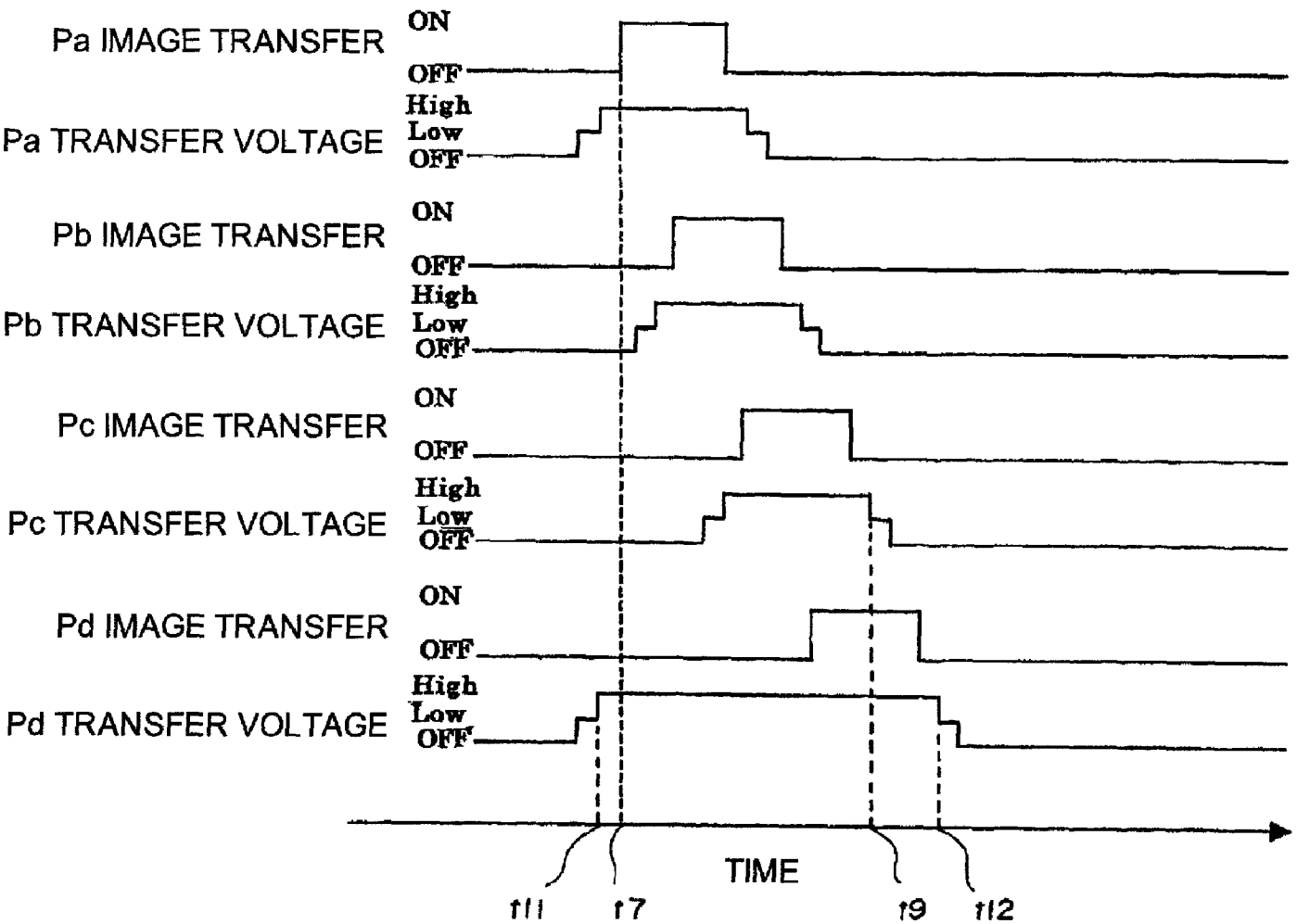
FIG. 6B shows an image and transfer voltage applying timing of the second embodiment of the invention.

As shown in FIG. 6B, the transfer bias applied to the transfer roller 53*d* of the process unit Pd is changed at the time except for the time from the timing t7 of starting the toner image transfer in the process unit Pa to the timing t9 of ending the toner image transfer in process unit Pc.

In FIG. 6B, the transfer bias is changed from +500 V (Low) to +1000 V (High) at timing t11, and the transfer bias is changed from +1000 V to +500 V at timing t12.

The control can suppress the generation of the defective image such as the density step caused by the interference of the transfer current in each process unit, even if the intermediate transfer belt has the lower resistance.

Third Embodiment

A third embodiment of the invention is based on an apparatus in which control for setting an optimum transfer bias, called ATVC, is used in the transfer bias application is performed by the constant-voltage control. A configuration and an operation of an image forming apparatus of the third embodiment are similar to those of the first embodiment, so that only the configuration and control different from the first embodiment will be described in detail.

In the transfer roller, not only a variation in resistance is hardly suppressed during production, but also the resistance is changed by environmental temperature and humidity changes or deterioration. In ATVC, the transfer voltage is detected when the desired transfer current is passed through the transfer roller 53 at timing except for the usual image formation, and the detected transfer voltage is applied at constant during the image formation.

The third embodiment is based on the transfer bias control method for avoiding the influence of the transfer current interference during ATVC voltage detection.

The ATVC operating method will be described in detail.

In the image forming apparatus of FIG. 1, although ATVC is operated in each process unit, the two ATVC operations in the process unit Pc which is of the first image forming portion and the process unit Pd which is of the second image forming portion will be described below.

(1) The surface of the photosensitive drum 1 of the process unit Pc of FIG. 2 is negatively charged by the charging means 2.

(2) When the charged region of the photosensitive drum 1 reaches the position where the intermediate transfer belt 51 is nipped, the constant-current bias (monitor current) is applied to the transfer roller 53, and the applied voltage is detected at that time by the detector 56. That is, the voltage-current relationship is detected by the detector 56 when the constant-current bias is applied to the transfer roller 53.

(3) The surface of the photosensitive drum 1 of the process unit Pd of FIG. 3 is positively charged by the charging means 2.

(4) The light is emitted from the exposure means 3 to expose the surface of the photosensitive drum 1, and the voltage is decreased to the potential at the background area in the surface of the photosensitive drum 1.

(5) When the region charged and exposed in the photosensitive drum 1 reaches the position where the intermediate transfer belt 51 is nipped, the constant-current bias is applied to the transfer roller 53, and the applied voltage is detected at that time by transfer voltage detection means (not shown).

Figure 7:
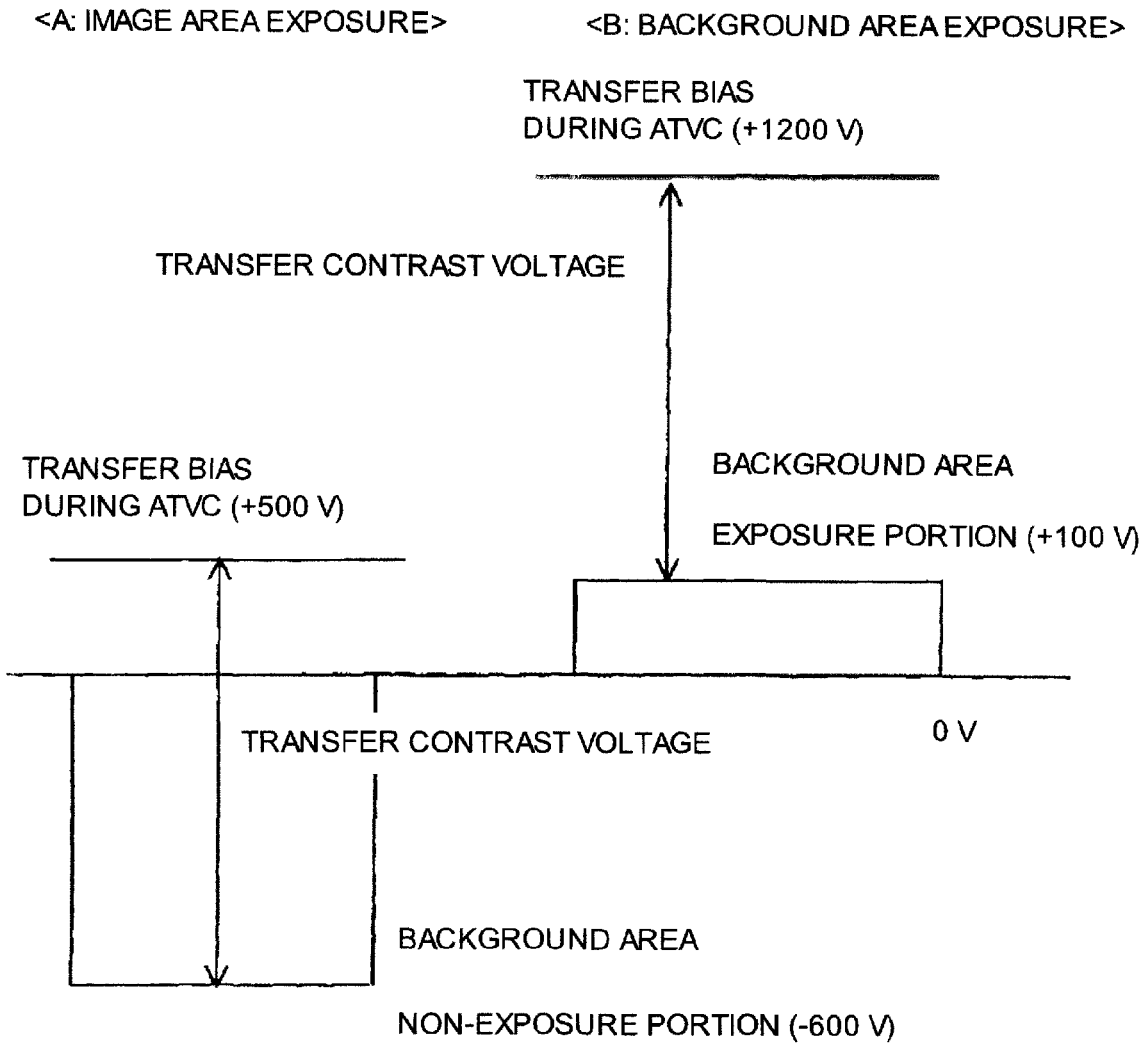
FIG. 7 shows a relationship between a photosensitive drum potential and a transfer voltage during ATVC according to a third embodiment of the invention.

The transfer voltage for obtaining the target transfer current is detected through the above procedure. As shown in FIG. 7, the transfer voltage in the process unit Pd of B: background area exposure is higher than the transfer bias during ATVC in the process unit Pc of A: image area exposure.

Therefore, the current flows from the transfer member 53*d* onto the side of the adjacent transfer member 53*c*, in the mid-flow as the constant-current bias is applied to the transfer member 53*d* of the process unit Pd while the constant-voltage control is performed to the transfer member 53*c* to detect the voltage in the process unit Pc.

Figure 8A:
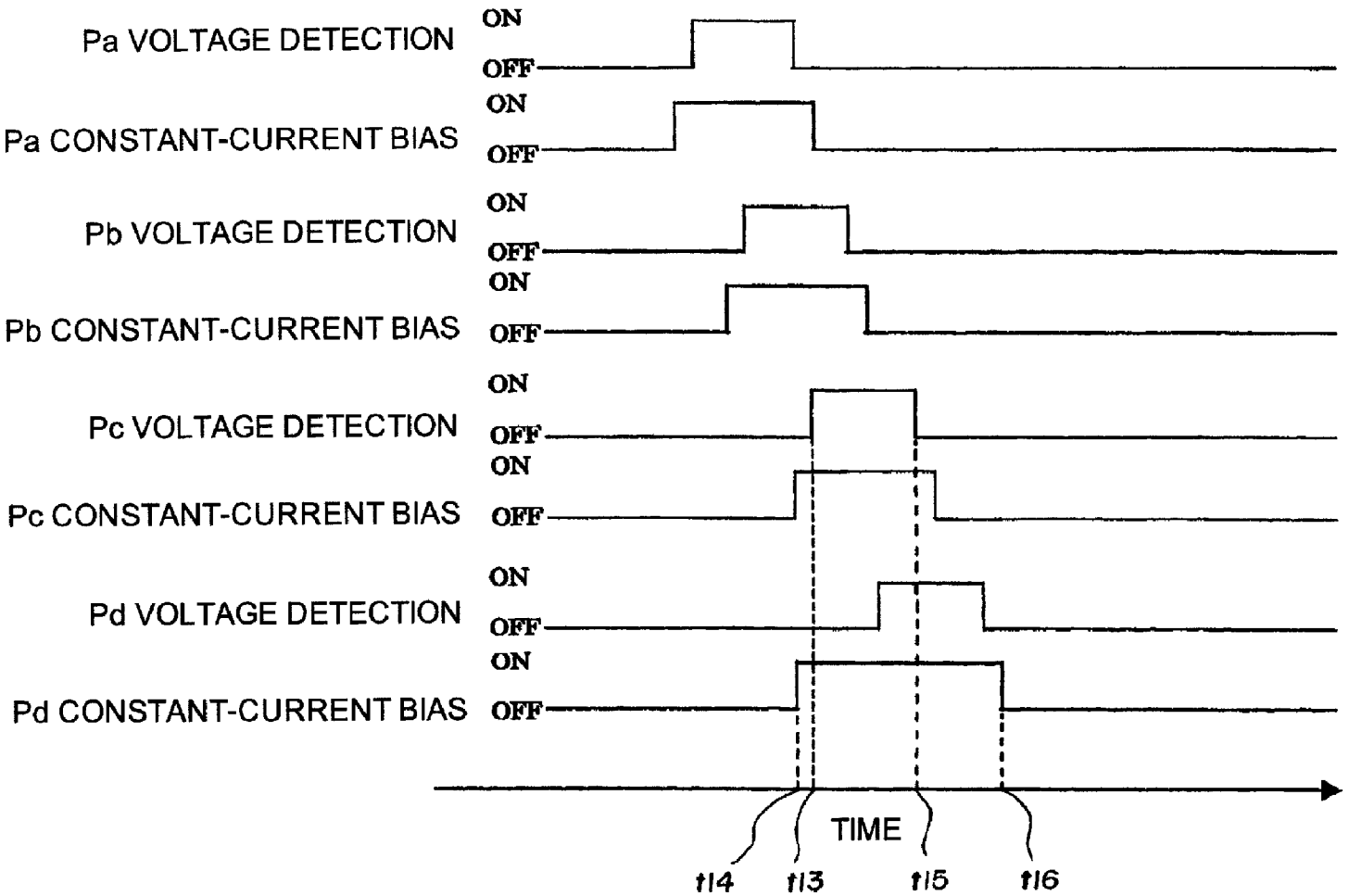
FIG. 8A shows transfer voltage applying timing during ATVC of the third embodiment of the invention.

In the third embodiment, the problem is avoided by applying the constant-current bias at timing shown in FIG. 8A. That is, the transfer voltage application is started in the adjacent process unit Pd in which the interference is easily generated at timing t14 before timing t13 of detecting the applied voltage in the process unit Pc.

The transfer voltage application is stopped in the process unit Pd at timing t16 after timing t15 of detecting the applied voltage in the process unit Pc.

Figure 8B:
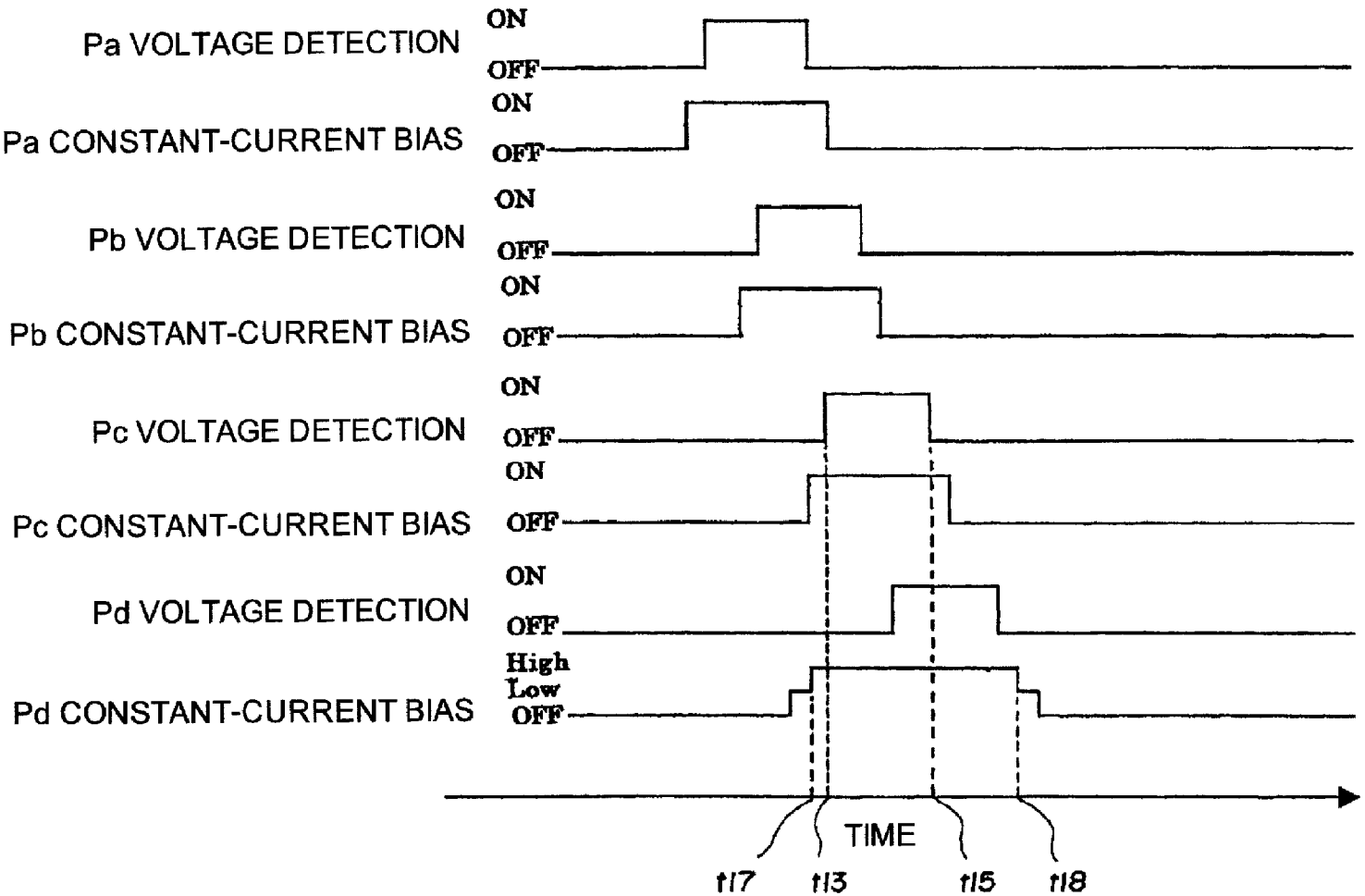
FIG. 8B shows transfer voltage applying timing during ATVC of the third embodiment of the invention.

As shown in FIG. 8B, the constant-current bias applied to the transfer roller 53*d* of the process unit Pd is changed at the time except for the time from the timing t3 of starting the detection of the constant-current bias in the process unit Pc to the timing t15 of ending the detection of the constant-current bias. In FIG. 8B, the transfer bias applied to the transfer roller 53*d* of the process unit Pd is changed from +100 V (Low) to +300 V (High) at timing t17.

In FIG. 8B, the transfer bias applied to the transfer roller 53*d* of the process unit Pd is changed from +300 V to +100 V at timing t18.

The voltage applied to the transfer roller 53*d* of the process unit Pd is changed or turned on and off at the time except for the time the voltage is applied to the transfer roller 53*c* of the process unit Pc to detect the voltage applied to the transfer roller 53*c*.

That is, the bias is applied to the transfer roller 53*c* of the process unit Pc in which the surface of the photosensitive drum is charged in the same polarity as the toner to form the latent image. Then, the charging output is kept constant in the transfer roller 53*d* of the process unit Pd in which the surface of the photosensitive drum is charged in the polarity opposite the toner to form the latent image, while the voltage applied to the transfer roller 53*c* is detected.

The charging output is kept constant in the transfer roller 53*d* of the background area exposure type process unit Pd, while the bias is applied to the transfer roller 53*c* of the background area exposure type process unit Pc to detect the voltage applied to the transfer roller 53*c*.

When the transfer bias is applied at the above timing, the fluctuation in resistance is not generated in the system, and the transfer voltage can stably be detected.

At this point, as shown in FIG. 7, the photosensitive drum 1 of the process unit Pc of A: image area exposure has the surface potential of −600 V, and the transfer bias for causing the predetermined target transfer current to flow is +500 V. The photosensitive drum 1 of the process unit Pd of B: background area exposure has the surface potential of +100 V, and the transfer bias for causing the predetermined target transfer current to flow is +1200 V.

A method in which the process unit Pc and the process unit Pd do not overlap each other in the transfer bias applying timing may be considered as means for avoiding the above problem. Unfortunately, a long time is required for ATVC in this method.

In the case where the method for simultaneously applying the transfer voltages to the process unit Pc and process unit Pd in the usual image forming operation as described in the first embodiment, even in ATVC, the transfer voltages are simultaneously applied to the process unit Pc and process unit Pd. Preferably the voltage is detected after the transfer voltages are simultaneously applied to the process unit Pc and process unit Pd.

The method for applying the constant-current bias to detect the voltage at that time is adopted in ATVC of the third embodiment. Alternatively, in ATVC, the constant-current bias (monitor voltage) may be applied to detect the current at that time, thereby detecting the voltage-current relationship. The same effect can be obtained.

Fourth Embodiment

Figure 9:
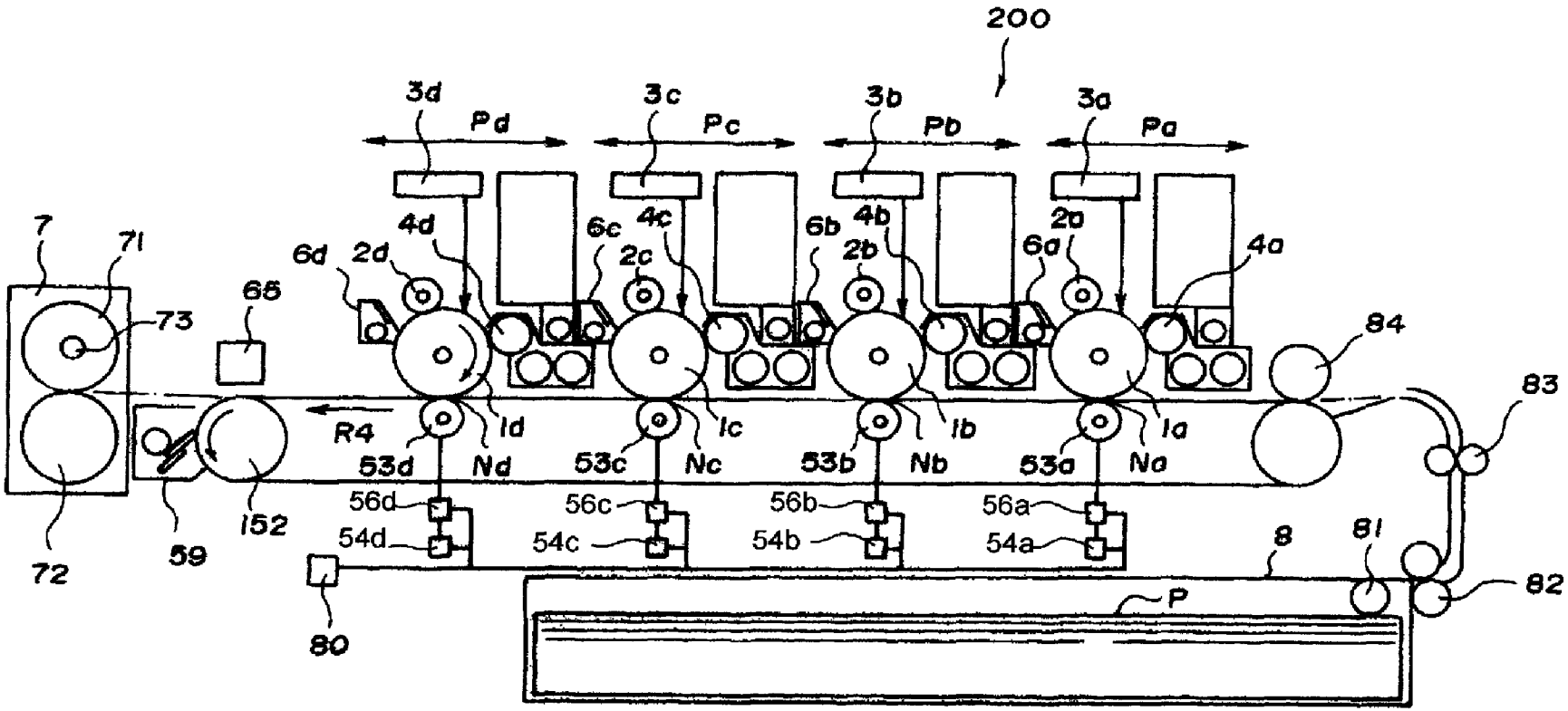
FIG. 9 shows a schematic configuration of an image forming apparatus according to a fourth embodiment of the invention.
Figure 10:
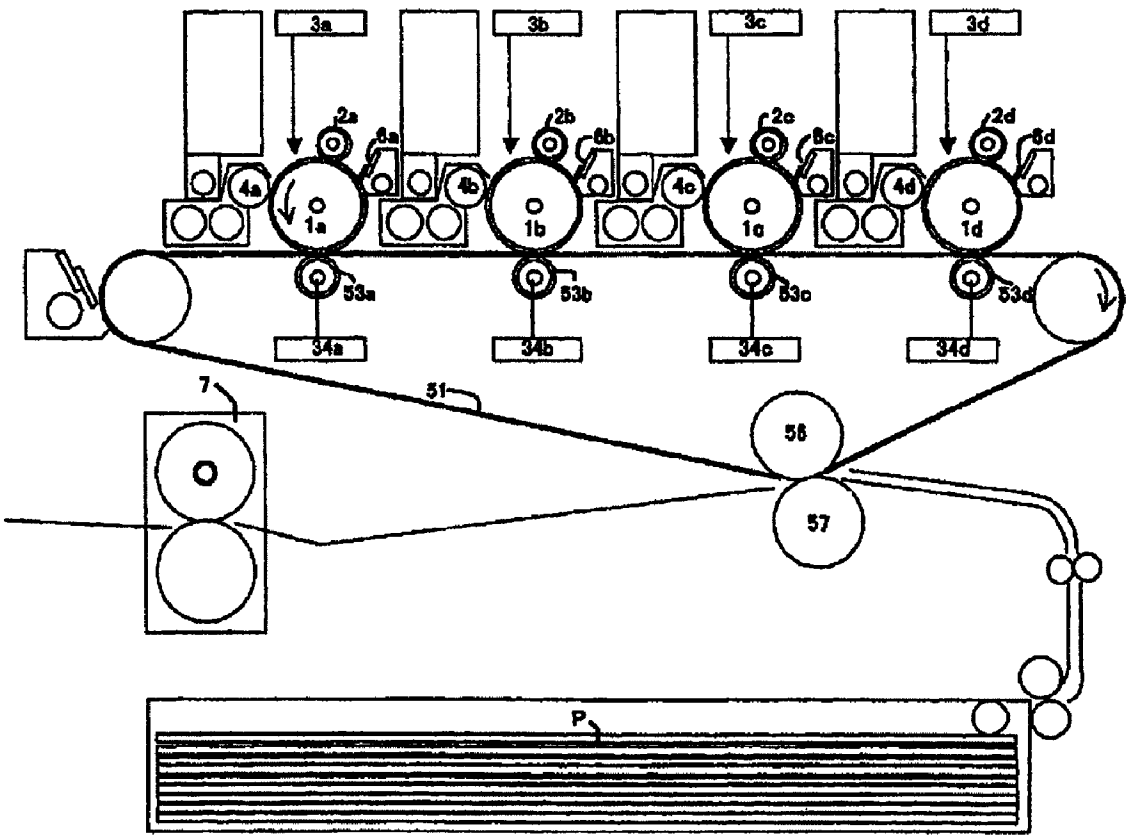
PRIOR ART FIG. 10
FIG. 10 shows a schematic configuration of a conventional image forming apparatus.
Figure 11:
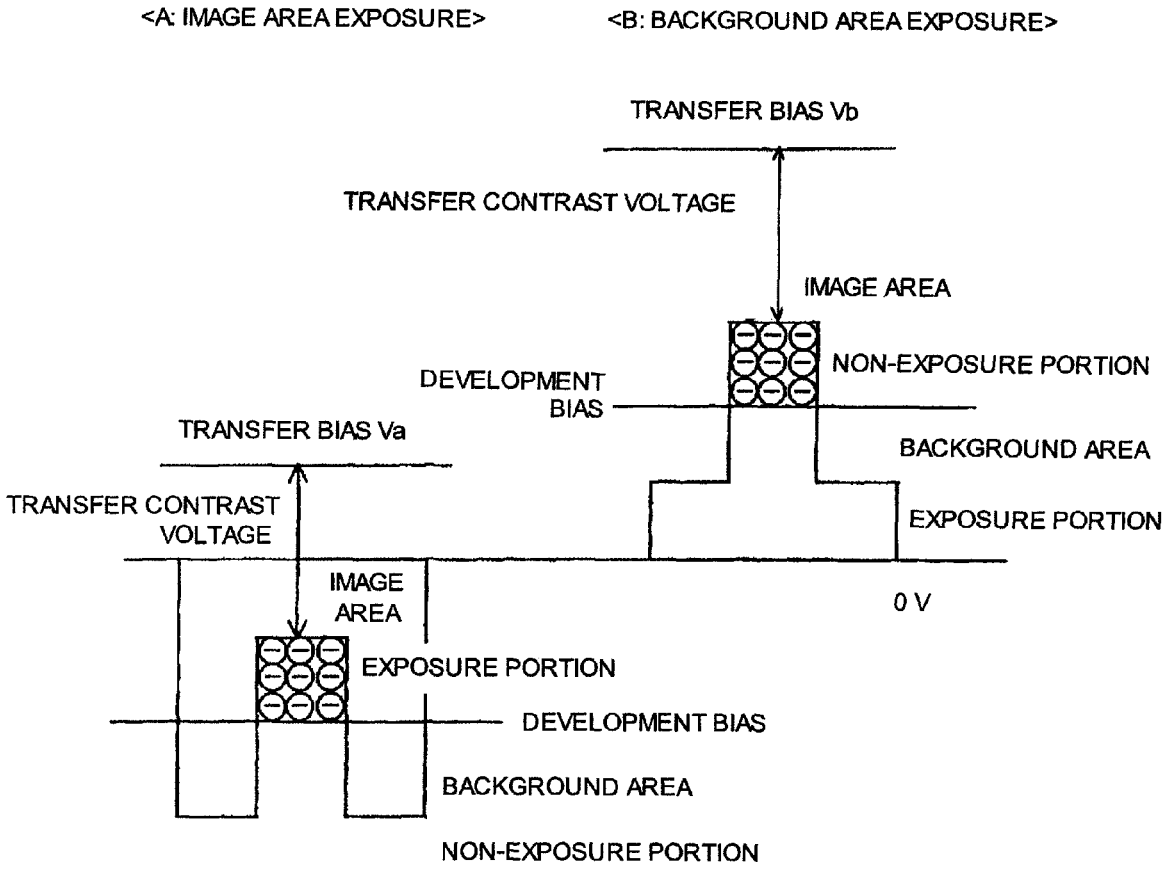
FIG. 11 shows a relationship between a photosensitive drum potential and a transfer voltage in the conventional image forming apparatus.

FIG. 9 shows a schematic configuration of an image forming apparatus according to a fourth embodiment of the invention. An image forming apparatus 200 of the fourth embodiment is a full-color electrophotographic image forming apparatus in which the direct transfer method is adopted.

In the image forming apparatus 200 of FIG. 9, the components having the substantially same function and configuration as those of the image forming apparatus 100 shown in FIG. 1 are designated by the same numeral, and the detailed description is neglected.

The image forming apparatus 200 includes a transfer belt 151 which is of a recording material conveyance belt next to the photosensitive drums 1*a* to 1*d* of the image forming portions Pa to Pd. The transfer belt 151 is entrained about a driving roller 152 and a tension roller 155. A driving force is transmitted to the transfer belt 151 by a driving roller 152 coupled to a motor mechanism (not shown) and the transfer belt 151 is rotated in the direction of the arrow R4.

In the inside surface of the transfer belt 151, the transfer rollers 53*a* to 53*d* are arranged at positions facing the photosensitive drums 1*a* to 1*d*. The transfer belt 151 is biased toward the photosensitive drums 1*a* to 1*d* by the transfer rollers 53*a* to 53*d* to form transfer portions (transfer nips) Na to Nd at which the photosensitive drums 1*a* to 1*d* comes into contact with the transfer belt 151 respectively.

In the image forming apparatus 200, the images on the photosensitive drums 1*a* to 1*d*, formed in the image forming portions Pa to Pd, are sequentially multiple-transferred to the recording material P such as paper on the transfer belt (recording material bearing belt) 151 which passes through the photosensitive drums 1*a* to 1*d* while brought into contact with the photosensitive drums 1*a* to 1*d*.

In forming the image, the recording material P taken out one by one from the cassette 8 by the pickup roller 82 is delivered to the transfer belt 151 through a registration roller 83. The recording material P is electrostatically absorbed onto the transfer belt 151 by a charging roller 84, and the recording material P is sequentially conveyed to the transfer portions Na to Nd of the image forming portions Pa to Pd while being integral with the transfer belt 151.

The photosensitive drums 1*a* to 1*c* of the image forming portions Pa to Pc which are of the first image forming portion are charged at −600 V by the charging means 2. The potential of −600 V is the potential at the background area. In the photosensitive drum surface exposed by the exposure means 3, the electricity is removed at −150 V. The electrostatic latent images formed on the photosensitive drums 1*a* to 1*c* are developed by the development means 4 to which the development bias (−400 V) is applied, and the toner images are formed. The transfer bias (+1800 V) is applied to the transfer rollers 53*a* to 53*c*, and the toner images on the photosensitive drums 1*a* to 1*c* are sequentially transferred onto the recording material P on the transfer belt 151.

On the other hand, the photosensitive drum 1*d* of the image forming portion Pd which is of the second image forming portion is charged at +550 V by the charging means 2. In the image forming portion Pd, the potential of +550 V is the potential at the image area. In the region exposed by the exposure means 3, the electricity is removed at +100 V. The potential of +100 is the potential at the background area. The electrostatic latent image formed on the photosensitive drum 1*d* is developed by the development means 4 to which the development bias (+350 V) is applied, and the toner image is formed. The transfer bias (+2500 V) is applied to the transfer roller 53*d*, and the toner image on the photosensitive drum 1*d* is transferred onto the recording material P onto which the toner images are transferred from the photosensitive drums 1*a* to 1*c*.

When the transfer processes are ended in the transfer portions Na to Nd, a separation charge removing device 65 applies a separation bias voltage to the recording material P to separate the recording material P from the transfer belt 151, and the recording material P is conveyed to the fixing device 7. After the transfer process, the toner (transfer residual toner) and the like remaining on the transfer belt 151 are removed and recovered by the belt cleaning device 59.

As with the intermediate transfer belt 51, the transfer belt 151 is made of a dielectric resin such as PC (polycarbonate), PET (polyethylene terephthalate), and PVDF (vinylidene fluoride). A carbon-dispersed PI resin having the surface resistivity of $10^{12.5}\Omega/\square$ (with a probe conformable to JIS-K6911, at applied voltage of 100 V for applied time of 60 sec, at 23° C. and 50% RH) and the thickness of 80 μm is used in the fourth embodiment. However, other materials, other surface resistivities, and other thickness may be used. The inventor's study shows that the interference phenomenon is frequently generated in the transfer belt having the surface resistivity not more than $10^{14}\Omega/\square$ like the image forming apparatus of the first embodiment. Particularly, the interference phenomenon is significantly generated in the transfer belt having the surface resistivity not more than $10^{13}\Omega/\square$. Therefore, the transfer belt having the surface resistivity not more than $10^{14}\Omega/\square$ or $10^{13}\Omega/\square$ is used as the transfer belt 151 of the fourth embodiment. Preferably the surface resistivity of the transfer belt 151 is not lower than $10^{9}\Omega/\square$ in order to prevent the splash during transfer.

The transfer roller 153 has the same configuration as the primary transfer roller 53. That is, the transfer roller 153 includes the core metal having an outer diameter of 8 mm and the conductive urethane sponge layer having the thickness of 4 mm. The transfer roller 153 has the resistance of about 106.5Ω (at 23° C. and 50% RH). The resistance of the transfer roller 153 is determined from the relationship of the current measured by applying the voltage of 100 V to the core metal, when the transfer roller 153 is rotated at a circumferential speed of 50 mm/sec while abutting on an electrically grounded metal roller under the condition that a load of 500 g weight is applied.

In the fourth embodiment, the yellow, magenta, cyan, and black color images are sequentially transferred to the recording material P, and the adjacent process units overlap each other in a period during which the image is transferred. Accordingly, as with the first embodiment, the transfer current interference is generated between the process unit Pc which is of the first image forming portion for forming the cyan image and the adjacent process unit Pd which is of the second image forming portion for forming the black image.

Therefore, as with the sequence shown in FIGS. 5A and 5B of the first embodiment, the transfer bias applied to the transfer roller 53*d* of the black image process unit Pd is changed or turned on and off at the time except for the interval during which the cyan image transfer to the recording material P is ended since started.

On the other hand, the extremely small interference current is generated because of the small potential difference between the transfer bias (+300 V) applied to the transfer roller 53*c* of the cyan image process unit Pc and the surface potential (+550 V) at the photosensitive drum 1*d* of the black image process unit Pd. Therefore, in the black image process unit Pd, the image density step is not generated at the timing of turning off the bias voltage of the transfer roller 53*c*.

Thus, the generation of the image density step caused by the interference with the adjacent cyan image process unit Pc at the timing of applying the transfer bias in the black image process unit Pd can be avoided even in the full-color electrophotographic image forming apparatus in which the direct transfer method is adopted.

In the fourth embodiment, as with the first embodiment, the constant-voltage control is used in the transfer biases applied to the transfer rollers 53*a* to 53*d*.

Furthermore, in the fourth embodiment, the transfer bias is controlled using the same ATVC as the third embodiment. The control of the transfer bias is similar to that of the third embodiment 3, so that the same action and configuration as the third embodiment are neglected. Likewise, in the fourth embodiment, as shown in FIGS. 8A and 8B, the constant-current bias applied to the process unit Pd is changed and turned on and off at the time except for the interval during which the voltage applied to the process unit Pd is detected. Thus, the trouble that the detection is not correctly performed by the interference with the cyan image process unit Pc, caused by the timing of applying the constant-current bias to the black image process unit Pd next to the cyan image process unit Pc, can be avoided even in the full-color electrophotographic image forming apparatus in which the direct transfer method is adopted.

This application claims the benefit of priority from the prior Japanese Patent Application No. 2006-292010 filed on Oct. 27, 2006 the entire contents of which are incorporated by reference herein.

What is claimed is:

1. An image forming apparatus comprising:

a first image forming portion, wherein the first image forming portion includes:

a first image bearing member;

first electrostatic latent image forming means for forming the first electrostatic latent image which is a predetermined polarity on the first image bearing member;

first development means for developing the first electrostatic latent image on the first image bearing member to form a toner image charged to the predetermined polarity; and a first transfer member for electrostatically transferring the toner image to a transfer material;

a second image forming portion disposed next to the first image forming portion, wherein the second image forming portion includes:

a second image bearing member;

second electrostatic latent image forming means for forming the second electrostatic latent image which is a polarity opposite the predetermined polarity on the second image bearing member;

second development means for developing the second electrostatic latent image on the second image bearing member to form a toner image charged to the predetermined polarity; and a second transfer member for electrostatically transferring the toner image to the transfer material;

transfer voltage applying means for applying transfer voltages to the first and second transfer members;

first detection means for detecting (i) a current when the transfer voltage applying means applies a predetermined voltage to the first transfer member or (ii) a voltage when the transfer voltage applying means passes a predetermined current through the first transfer member;

first determination means for determining the transfer voltage applied to the first transfer means for transferring the toner image on the first image bearing member to the transfer material based on the detection result of the detection means; and control means for controlling the transfer voltage applying means such that the voltage applied to the second transfer member is neither changed nor turned on and off in a period during which the first detection means detects the current passed through the first transfer member or the voltage applied to the first transfer member.

2. The image forming apparatus according to claim 1, wherein said control means further controls the transfer voltage applying means such that the transfer voltage applied to the second transfer member is neither changed nor turned on and off in a period during which the toner image is transferred to the transfer material in the first image forming portion.

3. The image forming apparatus according to claim 1, wherein an absolute value of the transfer voltage applied to the second transfer member is larger than an absolute value of the transfer voltage applied to the first transfer member.

4. The image forming apparatus according to claim 3, wherein said control means further controls the transfer voltage applying means such that the voltage applied to the first transfer member is capable of either being changed or turned on and off in a period during which the toner image is transferred to the transfer material in the second image forming portion.

5. The image forming apparatus according to claim 3, further comprising:

second detection means for detecting (i) a current when the transfer voltage applying means applies a predetermined voltage to the second transfer member or (ii) a voltage when the transfer voltage applying means passes a predetermined current through the second transfer member; and second determination means for determining the transfer voltage applied to the second transfer means for transferring the toner image on the second image bearing member to the transfer material based on the detection result of the second detection means, wherein said control means further controls the transfer voltage applying means such that the voltage applied to the first transfer member is capable of either being changed or turned on and off in a period during which the second detection means detects the current passed through the second transfer member or the voltage applied to the second transfer member.

6. The image forming apparatus according to claim 1, wherein the transfer material is an intermediate transfer belt for bearing images transferred by each the image bearing members and a surface resistivity of the intermediate transfer belt is not more than $10^{13}$ Ω/□.

7. The image forming apparatus according to claim 1, further comprising:

a recording material bearing belt for bearing the recording material, wherein the transfer material is the recording material borne by the recording material bearing member, and a surface resistivity of the recording material bearing belt is not more than $10^{13}$ Ω/□.

8. An image forming apparatus comprising:

a first image forming portion;

wherein the first image forming portion includes:

a first image bearing member;

first development means for developing a first electrostatic latent image to form a toner image, the first electrostatic latent image being formed by exposing the charged first image bearing member, and the toner image being formed in an exposure region of the first image bearing member; and a first transfer member which electrostatically transfers the toner image to a transfer material, a second image forming portion disposed next to the first image forming portion;

wherein the second image forming portion includes:

a second image bearing member;

second development means for developing a second electrostatic latent image to form a toner image, the second electrostatic latent image being formed by exposing the charged second image bearing member, and the toner image being formed in a non-exposure region of the second image bearing member; and a second transfer member which electrostatically transfers the toner image to the transfer material;

transfer voltage applying means for applying transfer voltages to the first and second transfer members;

first detection means for detecting (i) a current when the transfer voltage applying means applies a predetermined voltage to the first transfer member or (ii) a voltage when the transfer voltage applying means passes a predetermined current through the first transfer member;

first determination means for determining the transfer voltage applied to the first transfer means on the first image bearing member to the transfer material based on the detection result of the first detection means; and control means for controlling the transfer voltage applying means such that the voltage applied to the second transfer member is neither changed nor turned on and off in a period during which the first detection means detects the current passed through the first transfer member or the voltage applied to the first transfer member.

9. The image forming apparatus according to claim 8, wherein the control means further controls the transfer voltage applying means such that the transfer voltage applied to the second transfer member is neither changed nor turned on and off in a period during which the toner image is transferred to the transfer material in the first image forming portion.

10. The image forming apparatus according to claim 8, wherein potential polarity of an exposure region of the first image bearing member and potential polarity of a non-exposure region of the second image bearing member are opposite to each other and an absolute value of the transfer voltage applied to the second transfer member is larger than absolute value of the transfer voltage applied to the first transfer member.

11. The image forming apparatus according to claim 10, wherein the control means further controls the transfer voltage applying means such that the voltage applied to the first transfer member is capable of either being changed or turned on and off in a period during which the toner image is transferred to the transfer material in the second image forming portion.

12. The image forming apparatus according to claim 10, further comprising:

second detection means for detecting (i) a current when the transfer voltage applying means applies a predetermined voltage to the second transfer member or (ii) a voltage when the transfer voltage applying means passes a predetermined current through the second transfer member;

second determination means for determining the transfer voltage applied to the second transfer means on the second image bearing member to the transfer material based on the detection result of the second detection means, wherein the control means further controls the transfer voltage applying means such that the voltage applied to the first transfer member is capable of either being changed or turned on and off in a period during which the second detection means detects the current passed through the second transfer member or the voltage applied to the second transfer member.

13. The image forming apparatus according to claim 10, wherein the transfer material is an intermediate transfer belt for bearing images transferred by each of the image bearing members and a surface resistivity of the intermediate transfer member is not more than $10^{13}$ Ω/□.

14. The image forming apparatus according to claim 10, wherein the transfer material is an intermediate transfer belt for bearing images transferred by each of the image bearing members and a surface resistivity of the intermediate transfer belt is not more than $10^{14}$ Ω/□.

* * * * *